US008267380B1

(12) United States Patent
Dormeville

(10) Patent No.: US 8,267,380 B1
(45) Date of Patent: Sep. 18, 2012

(54) RETRACTABLE FENCE APPARATUS

(76) Inventor: Stephanie Dormeville, Freeport, NY (US)

( * ) Notice: Subject to any disclaimer, the term of this patent is extended or adjusted under 35 U.S.C. 154(b) by 246 days.

(21) Appl. No.: 12/658,955

(22) Filed: Feb. 18, 2010

(51) Int. Cl.
*E01F 15/00* (2006.01)

(52) U.S. Cl. ..... 256/1; 256/22; 256/DIG. 2

(58) Field of Classification Search ..... 256/1, 13.1, 256/22–26, 34, 73, DIG. 2; 404/6, 9; 405/106; 4/506; 312/306, 312; 108/145
See application file for complete search history.

(56) References Cited

U.S. PATENT DOCUMENTS

| | | | | | |
|---|---|---|---|---|---|
| 2,706,102 | A | * | 4/1955 | Cresci | 254/8 C |
| 2,760,759 | A | * | 8/1956 | Rice | 256/34 |
| 3,630,489 | A | | 12/1971 | Cordell, Sr. | |
| RE28,455 | E | * | 7/1975 | Denier et al. | 182/16 |
| 3,974,599 | A | | 8/1976 | Grosh | |
| 4,555,090 | A | | 11/1985 | Averhoff | |
| 4,712,653 | A | * | 12/1987 | Franklin et al. | 187/269 |
| 4,844,423 | A | | 7/1989 | Combs | |
| 5,168,584 | A | * | 12/1992 | Peebles | 4/504 |
| 5,203,817 | A | | 4/1993 | Klumpjan | |
| 5,630,572 | A | * | 5/1997 | Guay | 256/1 |
| 5,836,155 | A | * | 11/1998 | Katoh | 60/276 |
| 5,871,038 | A | | 2/1999 | Gompertz et al. | |
| 6,361,131 | B1 | * | 3/2002 | Powell, Jr. | 312/312 |
| 6,601,831 | B2 | * | 8/2003 | Erwin | 256/65.05 |
| 6,612,670 | B2 | * | 9/2003 | Liu | 312/312 |
| 6,886,296 | B1 | * | 5/2005 | John et al. | 52/170 |
| 7,329,067 | B1 | * | 2/2008 | Rodriguez | 404/6 |

* cited by examiner

*Primary Examiner* — Michael P Ferguson
*Assistant Examiner* — Nahid Amiri
(74) *Attorney, Agent, or Firm* — Richard L. Miller

(57) ABSTRACT

A retractable fence apparatus which comprises a housings. The housing has a bottom wall, a top wall with a longitudinal slot, a rear wall, a front wall and a pair of side walls. The housing is installed within the ground with the top wall level with the top of the ground. A of lift mechanism is provided. The lift mechanism is installed onto the bottom wall within the housing. A barrier assemblies are also provided. The barrier assembly is installed within the housing of the lift mechanism. A mechanism is for operating lift mechanism, wherein a the barrier assembly can be raised up and lowered down through the longitudinal slot in the top wall of the housing.

10 Claims, 7 Drawing Sheets

1' TO ∞
3' TO 12'
20
22
24
26
28
30
32
34
36
40
42
44
46
48
50
52
58
60
62
64
68
72

20
22
24
26
28
30
32
36
38
40
42
44
46
48
50
52
54
56
58
60
62
64
68
72
74

RETRACTABLE FENCE APPARATUS

BACKGROUND OF THE INVENTION

1. Field of the Invention

The present invention relates to a fence, and more particularly, a retractable fence apparatus.

2. Description of the Prior Art

Numerous innovations for fencing systems have been provided in the prior art that will be described. Even though these innovations may be suitable for the specific individual purposes to which they address, however, they differ from the present invention.

A FIRST EXAMPLE, U.S. Patent Office Document No. 3,360,489, Issued on Dec. 28, 1971, to Cordell Sr. teaches a pointed cast-iron tip, to facilitate driving into the ground, having drain passages, is fitted into the end of a section of pipe. The pipe provides lateral support to the inserted post and the tip provides drain passages for water and vertical support for the post. A cover prevents the entry of foreign material into the holder when it is not holding a post. Holders are permanently positioned by driving them in the ground at the predetermined post intervals of the snow fence.

A SECOND EXAMPLE, U.S. Patent Office Document No. 3,974,599, Issued on Aug. 17, 1976, to Grosh teaches an underground reinforced plastic enclosure comprising a vertically and circumferentially stiffened body. The body is made of a fiberglass polyester resin and the stiffeners are of a reinforced plastic mortar. The body is suitable for surrounding a transformer or an oil switch used in underground utilities. On the body is seated a top cap made of reinforced plastic mortar. The top cap is formed with a central opening. Seated on the top cap is a reinforced plastic mortar cover plate or a metal grate. Depending from the top cap is a fiberglass polyester resin baffle and tamper shield. The body seats on a base of reinforced plastic mortar. A grade adjustment skirt also depends from the top cap outwardly from the baffle and tamper shield.

A THIRD EXAMPLE, U.S. Patent Office Document No. 4,555,090, Issued on Nov. 26, 1985, to Averhoff teaches a fence post driving and pulling apparatus that includes a frame, a track, a traveling slide, means for mounting the frame on a tractor, means for selectively securing a fence post to the traveling slide, and means for driving the traveling slide. The frame mounts to a tractor and the track is formed in the frame. The traveling slide is disposed for substantially vertical displacement within the track as driven by a hydraulic cylinder which is connected between the frame and the traveling slide. The hydraulic cylinder is actuated by the hydraulic power system available on the tractor upon which the device is mounted. A first clamp surface projecting from the traveling slide and an adjacent cam clamp surface presented by a cam which is rotatably connected to the traveling slide provide means for selectively securing the fence post to the traveling slide. A fence post is brought into place upon the face of the traveling slide between the first clamp surface and the cam clamp surface. Rotating the cam closes the gap between the cam clamp surface and the first clamp surface, thereby securely gripping the fence post to the traveling slide. Actuation of the hydraulic cylinder then lowers or raises the fence post with the traveling slide to drive or pull the fence post into and out of engagement with the ground.

A FOURTH EXAMPLE, U.S. Patent Office Document No. 4,844,423, Issued on Jul. 4, 1989, to Combs teaches a portable cattle guard which includes an assembled rectangularly shaped base member. Contained within the confines of the base member are a pair of inclined spring biased cattle ramps moveably connected along their longitudinal axis to provide a slight apex when in the relaxed state. The base member includes a pair of hollow vertical posts having inwardly facing guide slots cut therein. Each hollow post contains a coiled spring fixed at its upper end to the upper section of the post. The other end of the spring is connected to an end section of a leading bar of one of the ramps which is sufficiently extended to enter each of the guide slots. When a vehicle is driven on the spring-biased ramp, the ramp is flattened so that it is substantially parallel with the ground surface. When the vehicle passes over the ramp, the extended spring returns the ramp to its normal relaxed apex forming position.

A FIFTH EXAMPLE, U.S. Patent Office Document No. 5,203,817, Issued on Apr. 20, 1993, to Klumpjan teaches a fence post bracket that is stamped from a single sheet of material and includes a back wall and three side walls for supporting a fence post on the major portion of its perimeter. The fence post side walls terminate in a plurality of legs providing for multiple point 7 support of the fence post in a concrete embedded post hole. The bottom of the fence post is supported above ground level and is unencumbered to provide for complete drainage of the fence post, minimizing deterioration of the fence post due to moisture retention.

A SIXTH EXAMPLE, U.S. Patent Office Document No. 5,871,038, Issued on Feb. 16, 1999, to Gompertz et al. teaches a remote-controlled mechanical locking chain gate which has an electrically controlled winding mechanism with a locking device to keep the chain tight and prevent the chain from loosening when pressure is applied to the chain thus putting it into a locked position. The chain gate can be lowered or raised from a remote location using an accompanying remote control device. The motor and mechanics used to raise and lower the chain are modular for easy repair and replacement, and enclosed in a protective covering in order to protect them from damage or tampering. The motor can be operated by alternating current or direct current to provide the user with flexibility and allow the gate to be operated either by direct wire to an electrical source or by one or more batteries or recharging solar cells, and used in remote places where there is no access to electrical power.

It is apparent now that numerous innovations for fencing systems have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a retractable fence apparatus that avoids the disadvantages of the prior art.

ANOTHER OBJECT of the present invention is to provide a retractable fence apparatus that is simple and inexpensive to manufacture.

STILL ANOTHER OBJECT of the present invention is to provide a retractable fence apparatus that is simple to use.

BRIEFLY STATED, STILL YET ANOTHER OBJECT of the present invention is to provide a retractable fence apparatus which comprises a plurality of housings. Each housing has a bottom wall, a top wall with a longitudinal slot, a rear wall, a front wall and a pair of side walls. Each housing is installed within the ground with the top wall level with the top of the ground. A plurality of lift mechanisms are provided. Each lift mechanism is installed onto the bottom wall within one housing. A plurality of barrier assemblies are also provided. Each barrier assembly is installed within one housing onto one lift mechanism. A mechanism is for operating each lift mechanism, wherein a portion of each barrier assembly can be raised up and lowered down through the longitudinal slot in the top wall of one housing.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
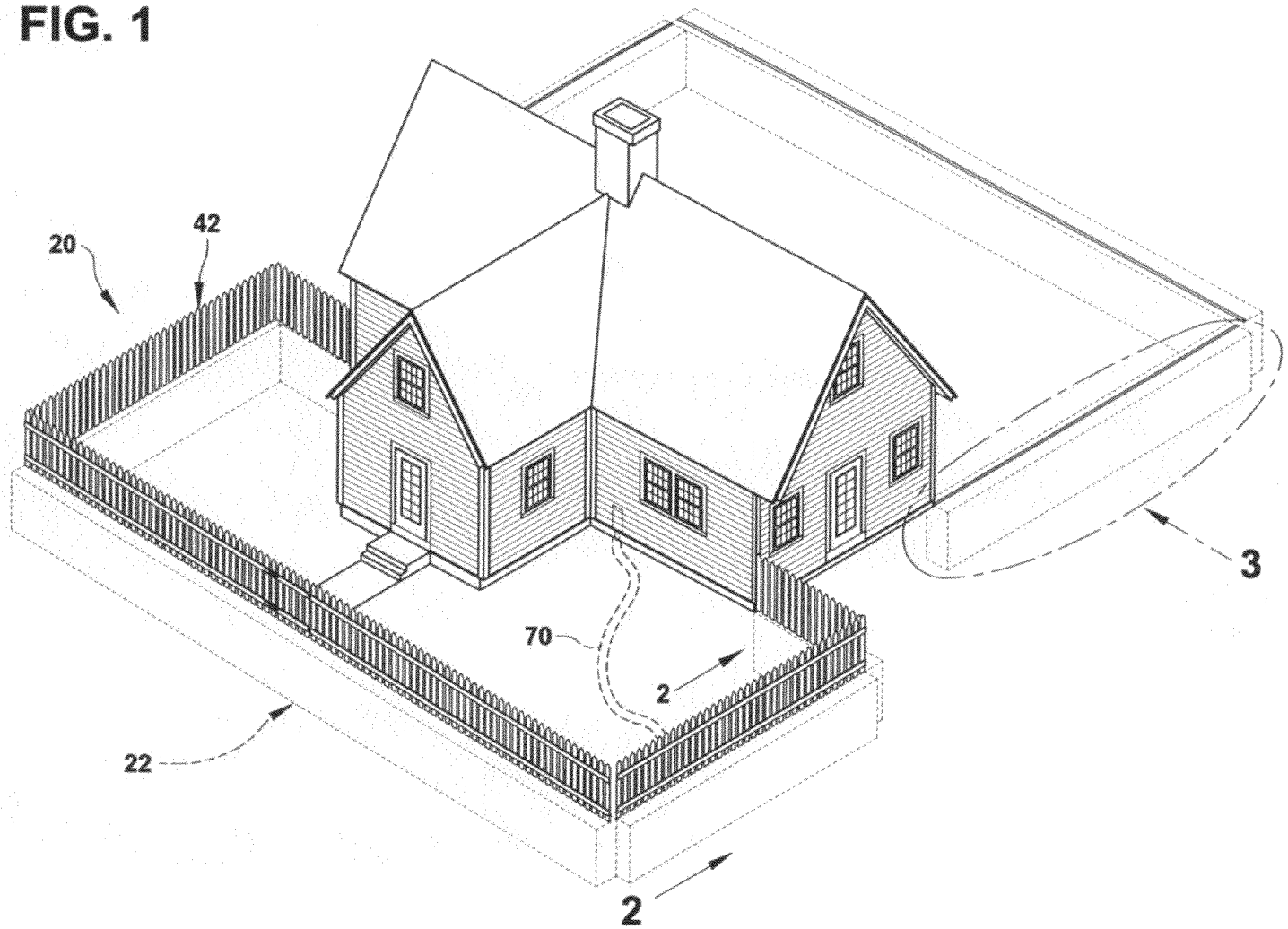
FIG. 1 is a diagrammatic perspective view of an embodiment of the present invention in use.
Figure 3:
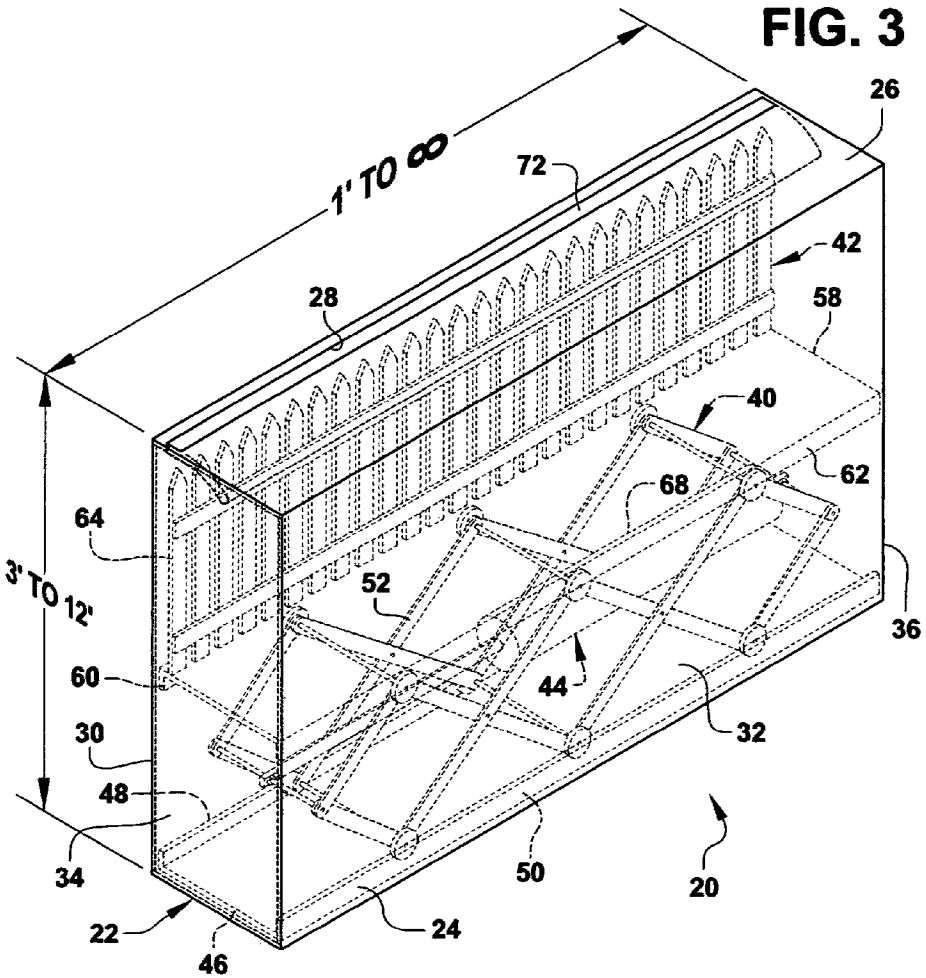
FIG. 3 is an enlarged diagrammatic perspective view of the enclosed area indicated by arrow 3 in FIG. 1.
Figure 2:
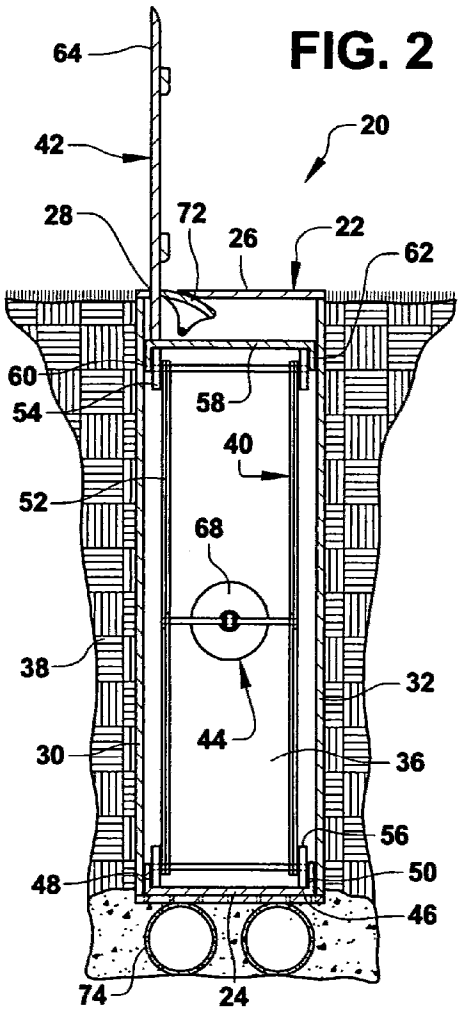
FIG. 2 is an enlarged diagrammatic cross sectional view taken along line 2-2 in FIG. 1.

20 retractable fence apparatus
22 housing of retractable fence apparatus 20
24 bottom wall of housing 22
26 top wall of housing 22
28 longitudinal slot in top wall 26
30 rear wall of housing 22
32 front wall of housing 22
34 first side wall of housing 22
36 second side wall of housing 22
38 ground
40 lift mechanism of retractable fence apparatus 20
42 barrier assembly of retractable fence apparatus 20
44 operating mechanism of retractable fence apparatus 20
46 base platform of lift mechanism 40
48 first upwardly extending side rail of base platform 46
50 second upwardly extending side rail of base platform 46
52 lazy tongs structure of lift mechanism 40
54 upper roller of lazy tongs structure 52
56 lower roller of lazy tongs structure 52
58 base platform of barrier assembly 42
60 first downwardly extending side rail of base platform 58
62 second downwardly extending side rail of base platform 58
64 picket fence structure of barrier assembly 42
68 cylinder and piston assembly of operating mechanism 44
70 remote control system of retractable fence apparatus 20
72 spring biased guard member of retractable fence apparatus 20
74 integrated drainage system of retractable fence apparatus 20

DETAILED DESCRIPTION OF THE PREFERRED EMBODIMENT

Figure 4:
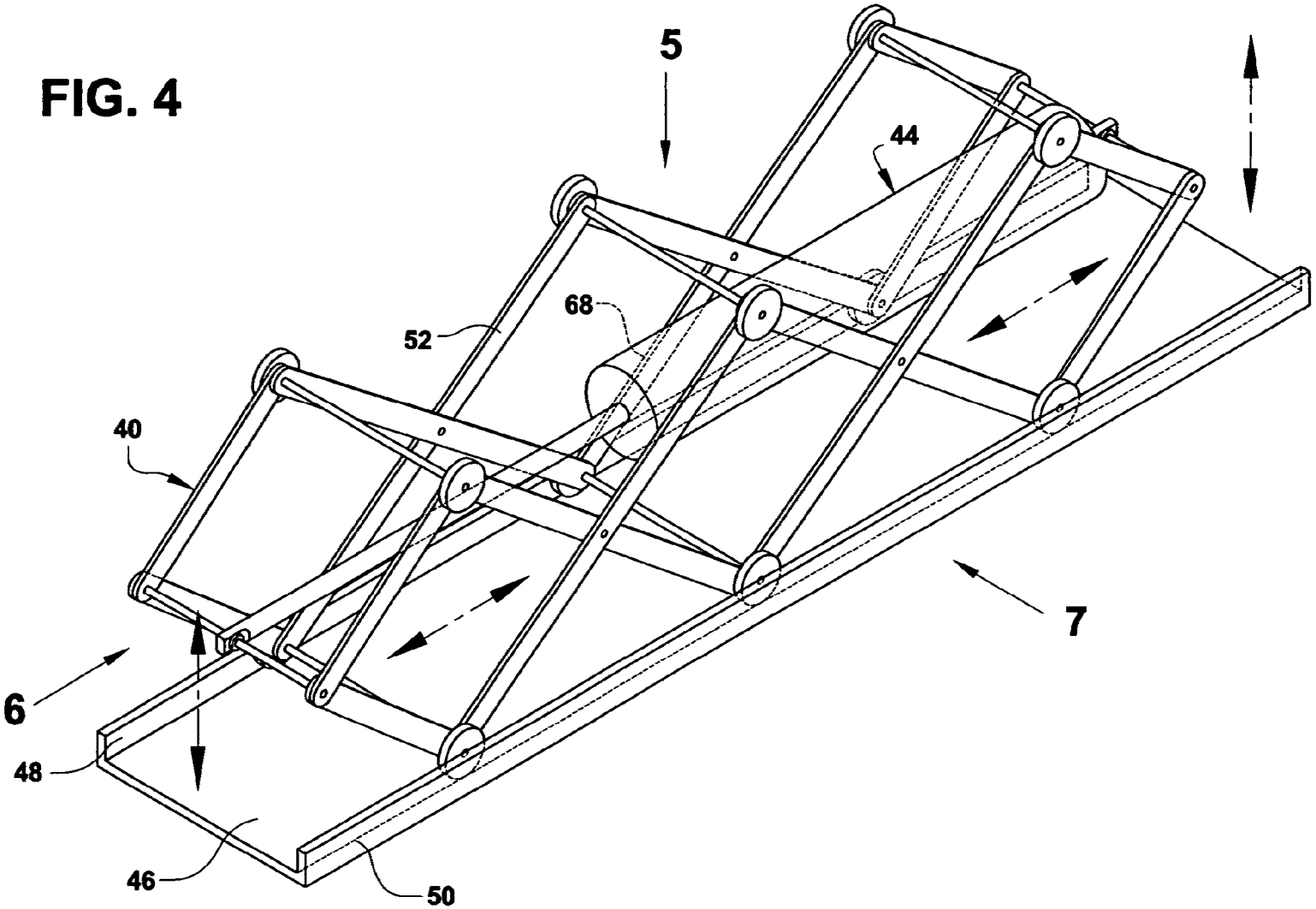
FIG. 4 is a further enlarged diagrammatic perspective view of the lift mechanism for raising and lowering the barrier assembly.
Figure 5:
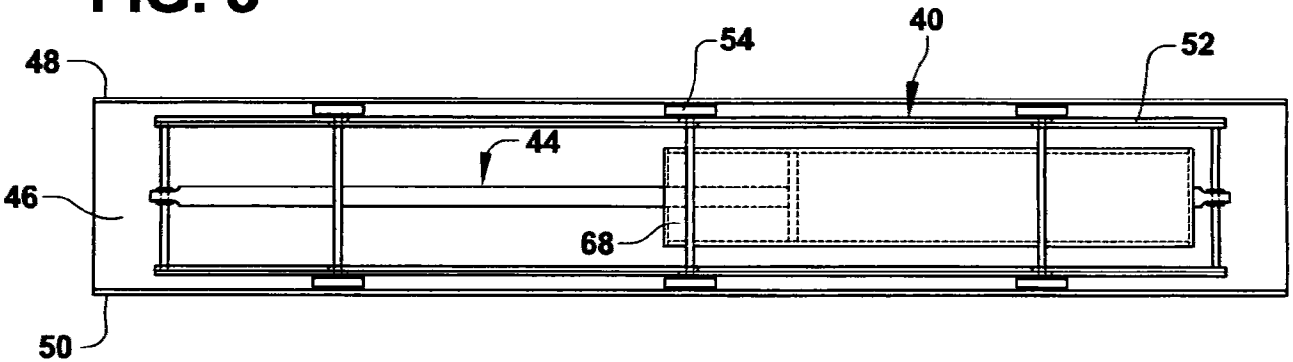
FIG. 5 is a diagrammatic top view taken in the direction of arrow 5 in FIG. 4.
Figure 7:
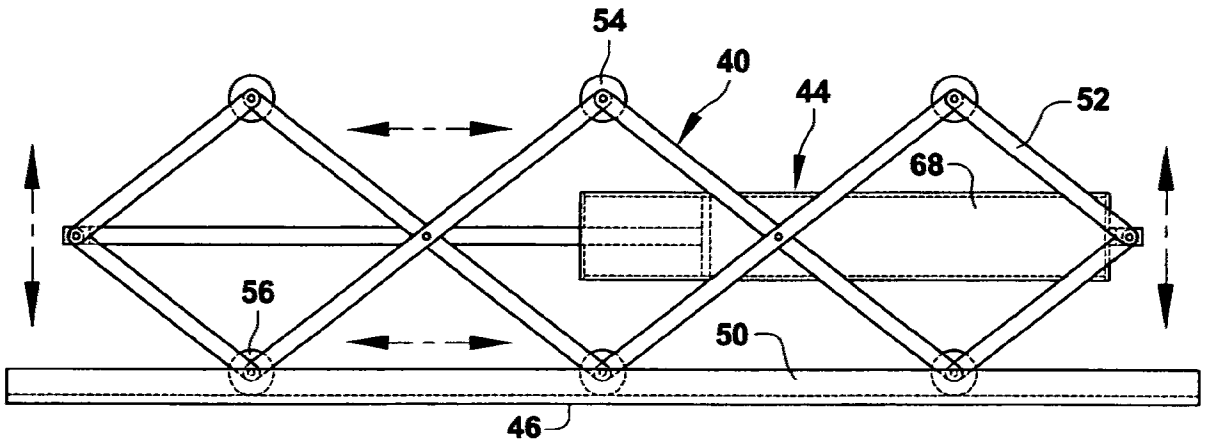
FIG. 7 is a diagrammatic front view taken in the direction of arrow 7 in FIG. 4.
Figure 6:
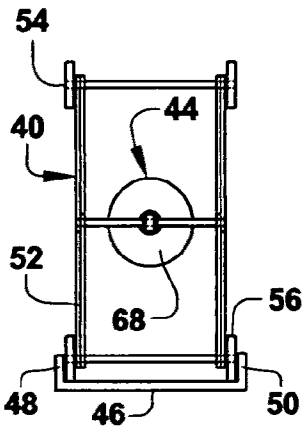
FIG. 6 is a diagrammatic end view taken in the direction of arrow 6 in FIG. 4.
Figure 8:
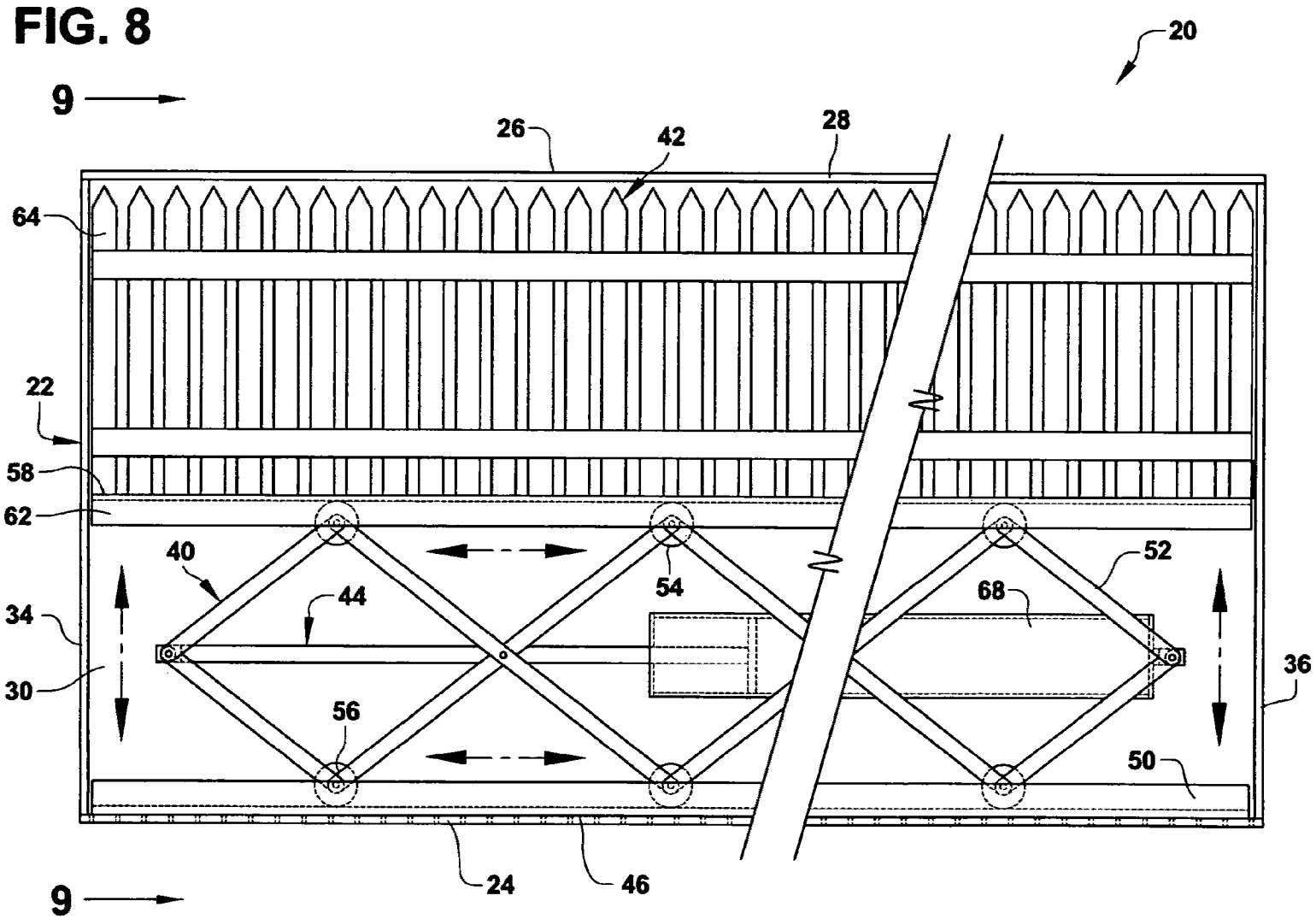
FIG. 8 is a diagrammatic front view with parts broken away of one segment of the present invention showing the front wall of the housing removed and the barrier assembly in a down stored away position.
Figure 9:
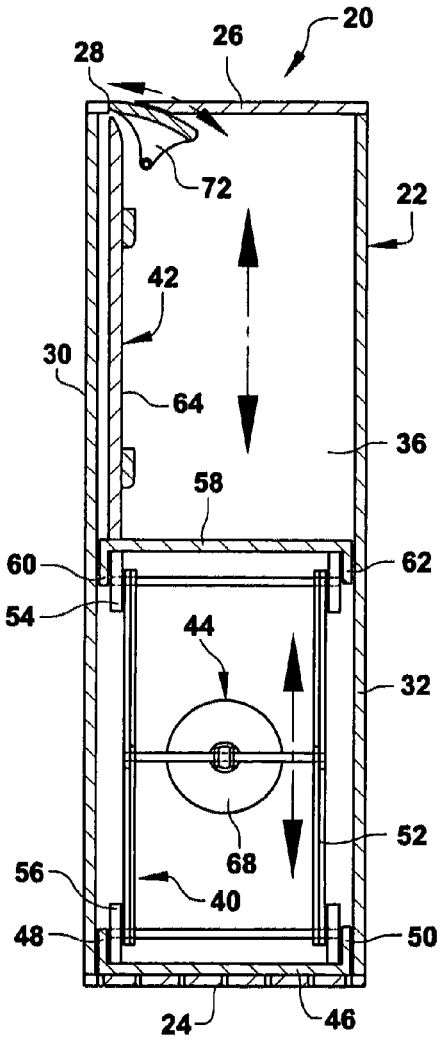
FIG. 9 is a diagrammatic cross sectional view taken generally along line 9-9 in FIG. 8.
Figure 11:
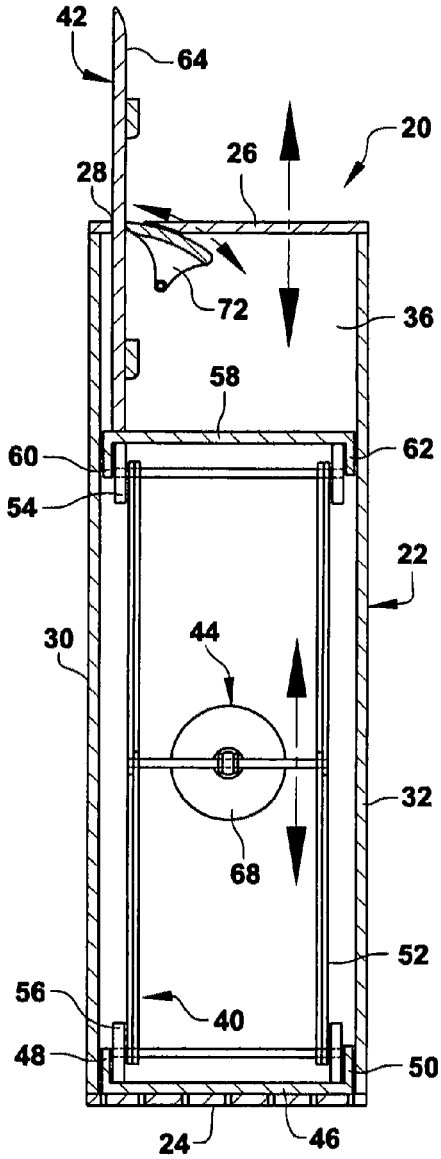
FIG. 11 is a diagrammatic cross sectional view taken generally along line 11-11 in FIG. 10.
Figure 10:
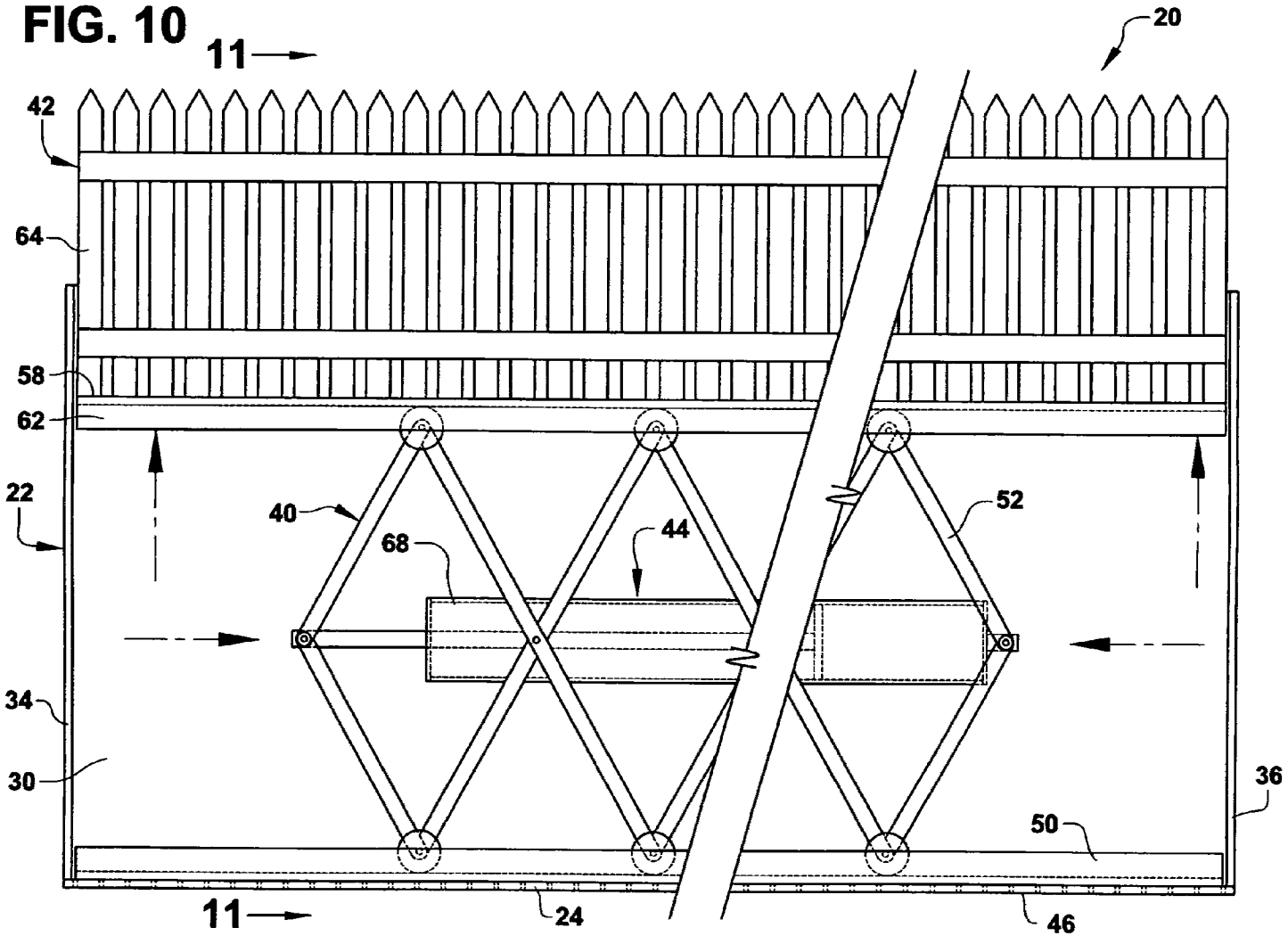
FIG. 10 is a diagrammatic front view similar to FIG. 8, showing the barrier assembly being raised up by the lift mechanism.

Referring now to the figures, in which like numerals indicate like parts, and particularly to FIGS. 1 through 11, which are a diagrammatic perspective view of an embodiment of the present invention in use; an enlarged diagrammatic cross sectional view taken along line 2-2 in FIG. 1; an enlarged diagrammatic perspective view of the enclosed area indicated by arrow 3 in FIG. 1; a further enlarged diagrammatic perspective view of the lift mechanism for raising and lowering the barrier assembly; a diagrammatic top view taken in the direction of arrow 5 in FIG. 4; a diagrammatic end view taken in the direction of arrow 6 in FIG. 4; a diagrammatic front view taken in the direction of arrow 7 in FIG. 4; a diagrammatic front view with parts broken away of one segment of the present invention showing the front wall of the housing removed and the barrier assembly in a down stored away position; a diagrammatic cross sectional view taken generally along line 9-9 in FIG. 8; a diagrammatic front view similar to FIG. 8, showing the barrier assembly being raised up by the lift mechanism; and a diagrammatic cross sectional view taken generally along line 11-11 in FIG. 10, and as such, will be discussed with reference thereto.

The present invention is a retractable fence apparatus 20 which comprises a plurality of housings 22. Each housing 22 has a bottom wall 24, a top wall 26 with a longitudinal slot 28, a rear wall 30, a front wall 32 and a pair of side walls 34, 36. Each housing 22 is installed within the ground 38 with the top wall 26 level with the top of the ground 38. A plurality of lift mechanisms 40 are provided. Each lift mechanism 40 is installed onto the bottom wall 24 within one housing 22. A plurality of barrier assemblies 42 are also provided. Each barrier assembly 42 is installed within one housing 22 onto one lift mechanism 40. A mechanism 44 is for operating each lift mechanism 40, wherein a portion of each barrier assembly 42 can be raised up and lowered down through the longitudinal slot 28 in the top wall 26 of one housing 22.

Each lift mechanism 40 comprises a base platform 46 having opposite upwardly extending side rails 48, 50. A lazy tongs structure 52 has a plurality of upper and lower rollers 54, 56. The lazy tongs structure 52 is positioned horizontally, wherein the lower rollers 56 will ride on top surface of the base platform 46 between the opposite upwardly extending side rails 48, 50.

Each barrier assembly 42 comprises a base platform 58 having opposite downwardly extending side rails 60, 62. A picket fence structure 64 is mounted vertically onto the base platform 58. The upper rollers 54 of the lazy tongs structure 52 will ride on bottom surface of the base platform 58 between the opposite downwardly extending side rails 60, 62.

Each operating mechanism 44 comprises a cylinder and piston assembly 68 operatively coupled horizontally between opposite ends of the lazy tongs structure 52. When the cylinder and piston assembly 68 is activated said lazy tongs structure 52 will extend and contract to lower and raise the picket fence structure 64 of each barrier assembly 42. The retractable fence apparatus 20 further comprises a remote control system 70 for activating each cylinder and piston assembly 68.

A spring biased guard member 72 is pivotally mounted within each housing 22 between the side walls 34, 36 and directly under the longitudinal slot 28 in the top wall 26. When the picket fence structure 64 is lowered down through the longitudinal slot 28 in said top wall 26, the spring biased guard member 72 will pivot to protect and cover the longitudinal slot 28 in the top wall 26 and prevent debris from entering the housing 22. The retractable fence apparatus 10 further comprises an integrated drainage system 74 located below the bottom wall 24 of each housing 22 to help remove water therefrom.

It will be understood that each of the elements described above, or two or more together, may also find a useful application in other types of constructions differing from the types described above.

While the invention has been illustrated and described as embodiments of a retractable fence apparatus, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A retractable fence apparatus which comprises:

a) a housing, said housing having a bottom wall, a top wall with a longitudinal slot, a rear wall, a front wall and a pair of side walls, wherein said housing is installed within the ground with said top wall level with the top of a ground;

b) a lift mechanism, wherein said lift mechanism is installed onto said bottom wall within said housing;

c) a barrier assembly, wherein said barrier assembly is installed within said housing onto said lift mechanism; and d) means for operating said lift mechanism, wherein a portion of said barrier assembly is raised up and lowered down through said longitudinal slot in said top wall of said housing, wherein said lift mechanism comprises:

e) a base platform having opposite upwardly extending side rails; and f) a lazy tongs structure comprising an expandable scissor linkage and having a plurality of upper and lower rollers attached to respective upper and lower ends of the linkage, said lazy tongs structure is positioned horizontally, wherein said lower rollers will ride on a top surface of a base platform of lift mechanism between said opposite upwardly extending side rails, wherein said upper rollers will ride on a bottom surface of a base platform of barrier assembly between said opposite downwardly extending side rails, wherein said barrier assembly comprises:

g) a base platform having opposite downwardly extending side rails; and h) a picket fence structure mounted vertically onto said base platform, wherein said upper rollers of said lazy tongs structure will ride on a bottom surface of said base platform between said opposite downwardly extending side rails.

2. The retractable fence apparatus as recited in claim 1, wherein said operating means comprises a cylinder and piston assembly operatively coupled horizontally between opposite ends of said lazy tongs structure, wherein when said cylinder and piston assembly is activated said lazy tongs structure will extend and contract to lower and raise said picket fence structure of each said barrier assembly.

3. The retractable fence apparatus as recited in claim 2, further comprising a remote control system for activating said cylinder and piston assembly.

4. The retractable fence apparatus as recited in claim 3, further comprising a spring biased guard member pivotally mounted within said housing between said side walls and directly under said longitudinal slot in said top wall, wherein when said picket fence structure is lowered down through said longitudinal slot in said top wall, said spring biased guard member will pivot to protect and cover said longitudinal slot in said top wall and prevent debris from entering said housing.

5. The retractable fence apparatus as recited in claim 4, further comprising an integrated drainage system located below said bottom wall of said housing to help remove water therefrom.

6. A retractable fence apparatus which comprises:

a) a plurality of housings, each said housing having a bottom wall, a top wall with a longitudinal slot, a rear wall, a front wall and a pair of side walls, wherein each said housing is installed within the ground with said top wall level with the top of a ground;

b) a plurality of lift mechanisms, wherein each said lift mechanism is installed onto said bottom wall within one said housing;

c) a plurality of barrier assemblies, wherein each said barrier assembly is installed within one said housing onto one said lift mechanism; and d) means for operating each said lift mechanism, wherein a portion of each said barrier assembly is raised up and lowered down through said longitudinal slot in said top wall of one said housing, wherein each said lift mechanism comprises:

e) a base platform having opposite upwardly extending side rails; and f) a lazy tongs structure comprising an expandable scissor linkage and having a plurality of upper and lower rollers attached to respective upper and lower ends of the linkage, said lazy tongs structure is positioned horizontally, wherein said lower rollers will ride on a top surface of a base platform of lift mechanism between said opposite upwardly extending side rails, wherein said upper rollers will ride on a bottom surface of a base platform of barrier assembly between said opposite downwardly extending side rails, wherein each said barrier assembly comprises:

g) a base platform having opposite downwardly extending side rails; and h) a picket fence structure mounted vertically onto said base platform, wherein said upper rollers of said lazy tongs structure will ride on a bottom surface of said base platform between said opposite downwardly extending side rails.

7. The retractable fence apparatus as recited in claim 6, wherein each said operating means comprises a cylinder and piston assembly operatively coupled horizontally between opposite ends of said lazy tongs structure, wherein when said cylinder and piston assembly is activated said lazy tongs structure will extend and contract to lower and raise said picket fence structure of each said barrier assembly.

8. The retractable fence apparatus as recited in claim 7, further comprising a remote control system for activating each said cylinder and piston assembly.

9. The retractable fence apparatus as recited in claim 8, further comprising a spring biased guard member pivotally mounted within each said housing between said side walls and directly under said longitudinal slot in said top wall, wherein when said picket fence structure is lowered down through said longitudinal slot in said top wall, said spring biased guard member will pivot to protect and cover said longitudinal slot in said top wall and prevent debris from entering said housing.

10. The retractable fence apparatus as recited in claim 9, further comprising an integrated drainage system located below said bottom wall of each said housing to help remove water therefrom.

* * * * *